United States Patent [19]

Bohlin

[11] Patent Number: 4,662,435

[45] **Date of Patent: * May 5, 1987**

[54] HEAT EXCHANGER COMPRISING NESTED CONTAINERS

[75] Inventor: Stig Bohlin, Göteborg, Sweden

[73] Assignee: AB Volvo Penta, Göteborg, Sweden

[ * ] Notice: The portion of the term of this patent subsequent to Jan. 5, 2002 has been disclaimed.

[21] Appl. No.: 356,395

[22] Filed: Mar. 9, 1982

[30] Foreign Application Priority Data

Mar. 19, 1981 [SE] Sweden ..... 8101757

[51] Int. Cl.[4] ..... F28F 7/02

[52] U.S. Cl. ..... 165/74; 165/41; 165/164; 165/119; 165/916

[58] Field of Search ..... 165/73, 74, 164, 167, 165/142, 154, 156

[56] References Cited

U.S. PATENT DOCUMENTS

| | | | |
|---|---|---|---|
| 153,874 | 4/1874 | Willis . | |
| 654,220 | 7/1900 | Bothwell | 165/74 |
| 707,023 | 8/1902 | Seither | 165/74 |
| 1,813,050 | 7/1931 | Hauk | 165/73 |
| 1,813,871 | 7/1931 | Ayers | 165/74 |
| 3,303,877 | 2/1967 | Ramen | 165/154 |

FOREIGN PATENT DOCUMENTS

| | | | |
|---|---|---|---|
| 97657 | 1/1964 | Denmark | 165/74 |
| 815805 | 10/1951 | Fed. Rep. of Germany | 165/156 |
| 29343 | 3/1958 | Finland . | |
| 586377 | 1/1925 | France | 165/74 |

*Primary Examiner*—Albert W. Davis, Jr.
*Attorney, Agent, or Firm*—Young & Thompson

[57] ABSTRACT

Heat exchanger, especially a combined cooling water filter device and oil cooler for sea-water cooled boat motors, in which the cover of the filter container is built together with a container extending down into the filter container and having an inlet and an outlet for the oil to be cooled. A bowl-shaped member inside the oil container conducts oil flowing from the inlet to the outlet along the wall of the oil container.

3 Claims, 2 Drawing Figures

HEAT EXCHANGER COMPRISING NESTED CONTAINERS

The present invention relates to a heat exchanger, comprising a container with an inlet and an outlet for a fluid medium and with means for conducting the medium from the inlet to the outlet along the insides of walls, the outsides of said walls being in contact with a medium of another temperature than the first-mentioned medium.

The work involved in installing a conventional heat exchanger, e.g. an oil cooler, of pipe or flat type in the cooling system of a motor for example includes, in addition to connecting the oil pipes, the cutting of cooling water pipes or hoses, the welding or soldering of connecting pieces and the like, and the connecting up of cooling water pipes, which means that the installation must in general be done by an expert.

The purpose of the present invention is generally to achieve a heat exchanger adapted to a cooling or heating system comprising a container, e.g. a filter container, fluid tank or the like, which heat exchanger can be installed without the need for the above-mentioned work of cutting, soldering and the like, so that the installation can be performed by a non-professional. A particular purpose is to achieve an oil cooler, especially for the servo-steering of a so-called inboard/outboard drive for boats, which can be connected to the motor cooling system without having to cut pipes and hoses and without having to mount special brackets for the cooler.

This is achieved according to the invention in a heat exchanger of the type described in the introduction in that the container is joined to a cover provided with inlet and outlet connections for an opening in a second container containing said medium of another temperature, and in that said walls extend down into the interior of the second container when the cover is mounted over the opening. Such a heat exchanger can be installed merely by replacing the standard cover of the second container with the cover joined to the first-mentioned container, and connecting the inlet and outlet oil hoses thereto.

Figure 1:
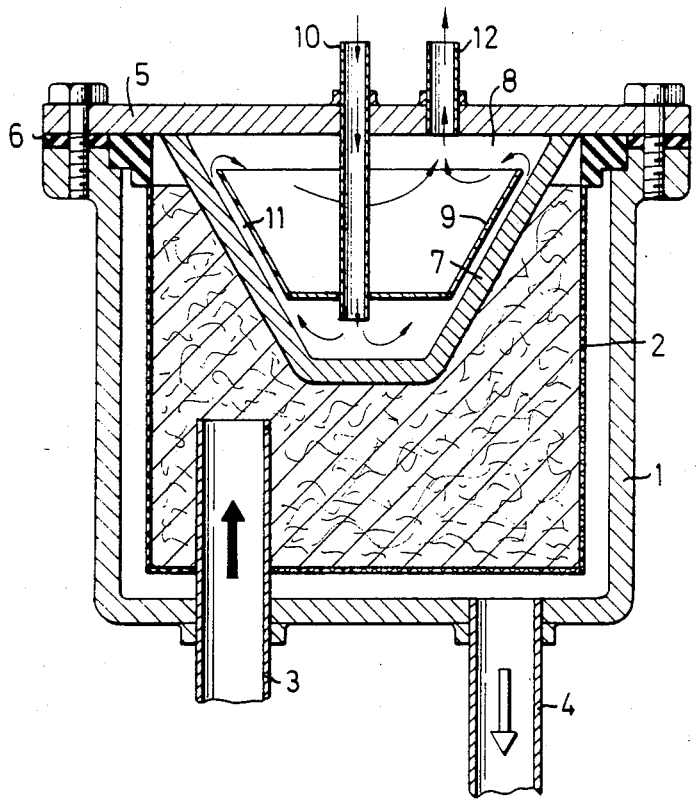
Figure 2:
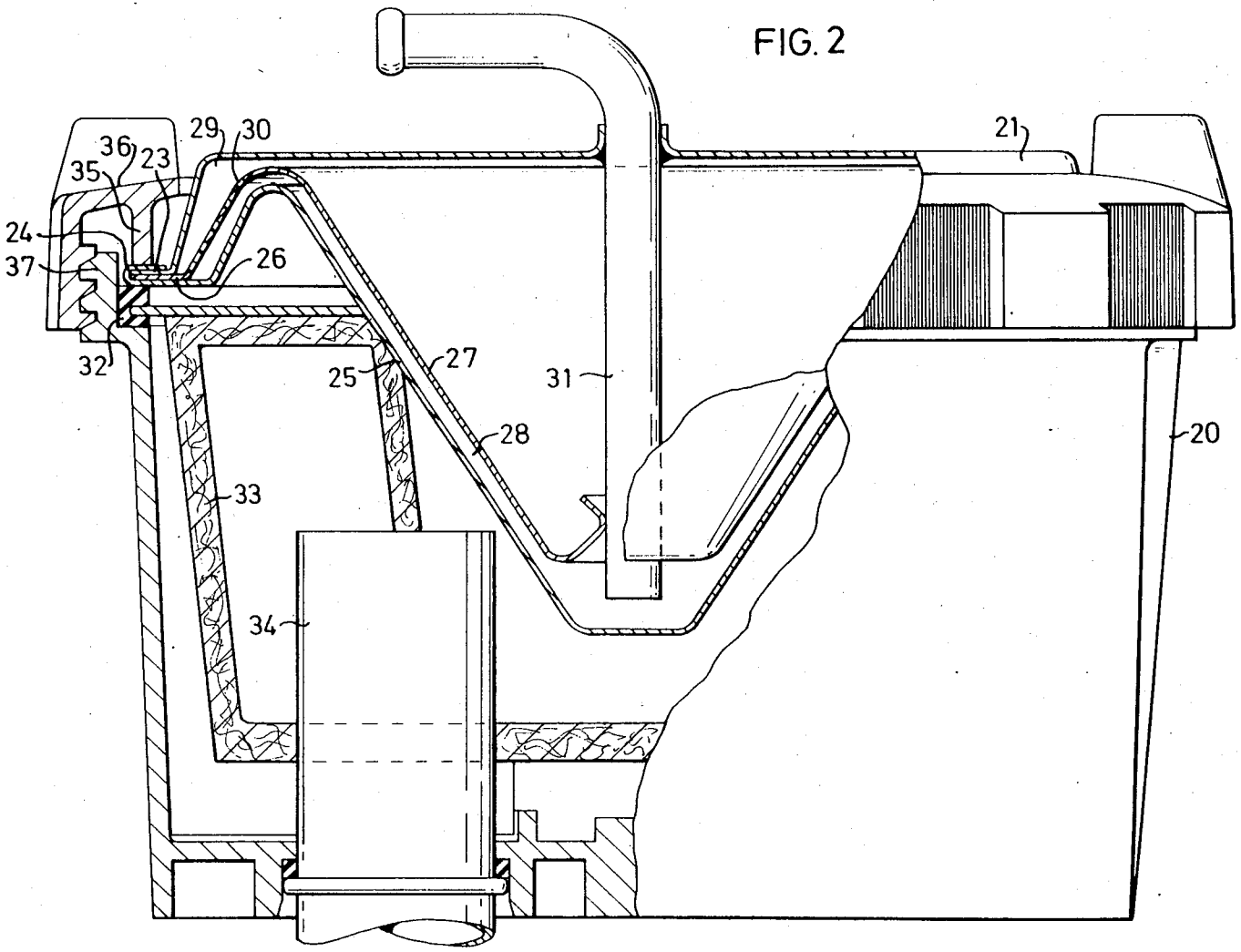

The invention will be described in more detail with reference to the examples shown on the accompanying drawings, of which FIGS. 1 and 2 show cross sections through two different embodiments of a heat exchanger according to the invention.

In FIG. 1, 1 designates a container for a filter 2, e.g. a cooling water filter for a sea-water cooled boat motor, with an inlet 3 and an outlet 4 for water. The container 1 is closed by a cover 5 screwed tightly to an edge flange with an intermediate gasket 6.

The underside of the cover 5 is joined to a bowl-shaped member 7, the edges of which are joined to the cover so as to be water-tight, e.g. by welding. Inside the space 8 defined by the cover 5 and the member 7, there is an additional bowl-shaped member 9 which is fixed to an inlet pipe 10, so as to form a space 11 between the two bowl-shaped members 7 and 9. The inlet pipe 10 opens into the intermediate space 11. Oil to be cooled flows from said inlet pipe through the intermediate space 11 and over the edge of the member 9 to an outlet 12. On its way from the inlet 10 to the outlet 12, the oil is cooled by the water which flows through the filter.

FIG. 2 shows a filter container 20 with an oil cooler built into the cover 21 thereof in a somewhat modified embodiment. The cover 21 is made of pressed sheet metal and has an outwardly bent flange edge 23 over which an edge 24 of a first bowl-shaped member 25 is folded, said first member also being made of pressed sheet metal. Between the flange edge 23 of the cover and the folded edge of the member 25, the edge 26 of a second bowl-shaped sheet metal member 27 is inserted. The space 28 between the members 25 and 27 communicates with the space 29 between the member 27 and the cover 21 via openings 30 in the member 27. The space 28 communicates with an inlet pipe 31 for oil to be cooled, while the space 29 communicates with an outlet pipe (not shown) for the oil. The edge 24 of the member 25 rests on a gasket 32 secured to a filter insert 33, into which an inlet pipe 34 opens and from which the cooling water flows through the insert 33 to an outlet (not shown). The edge 24 of the bowl-shaped member 25 is pressed against the gasket 32 by a downwardly directed flange 35 on a rock ring 36 which is in threaded engagement with a threaded flange 37 at the lip of the container.

When an oil cooler according to the invention is to be installed in an existing cooling water system, it is only necessary to screw off the standard cover of the filter container 20 and place the oil cooler formed by the cover 21 and the members 25,27 over the container opening and screw it down with the locking ring 36.

What I claim is:

1. In a heat exchanger comprising a container with an inlet and an outlet for a fluid medium and with means for conducting the medium from the inlet to the outlet along the insides of walls of the container, the outsides of said walls being in contact with a medium of another temperature than the first-mentioned medium; the improvement in which the container is joined to a cover provided with inlet and outlet connections, the cover closing an opening in a second container containing said medium of another temperature, and said walls extending down into the interior of the second container, the first-mentioned container being a first bowl-shaped member, the edges of which are sealingly joined to the cover, a second bowl-shaped member being arranged inside the first member spaced from the walls thereof, an inlet pipe extending through the cover and the second bowl-shaped member and opening into the intermediate space between the members, and an outlet pipe extending through the cover and opening into the space defined by the second member and the cover and which communicates with said intermediate space.

2. Heat exchanger according to claim 1, in which the edge of the second bowl-shaped member is spaced from the cover so that the medium in the intermediate space between the members can flow over an edge of the second bowl-shaped member.

3. Heat exchanger according to claim 1, in which the bowl-shaped members consist of pressed sheet metal parts, the edges of which are sealingly joined to one another, the second bowl-shaped member being made with openings through which the medium in the intermediate space between the members can flow to the outlet.

* * * * *